United States Patent [19]

Hawk

[11] 4,209,883

[45] Jul. 1, 1980

[54] PAINT APPLICATOR ROLLER CONSTRUCTION

[75] Inventor: Gary D. Hawk, Iola, Kans.

[73] Assignee: Harding Development Company, Clearwater, Fla.

[21] Appl. No.: 903,142

[22] Filed: May 5, 1978

[51] Int. Cl.[2] ..... B21B 13/02

[52] U.S. Cl. ..... 29/116 R; 29/110.5; 15/230.11

[58] Field of Search ..... 29/116 R, 110.5, 129; 15/230.11; 16/DIG. 13

[56] References Cited

U.S. PATENT DOCUMENTS

| | | | |
|---|---|---|---|
| 2,368,513 | 1/1945 | Adams | 15/230.11 |
| 2,722,029 | 11/1955 | Barnes et al. | 29/116 R |
| 2,747,210 | 5/1956 | Canning et al. | 29/116 R X |
| 3,094,770 | 6/1963 | Williams | 29/116 R |
| 3,877,123 | 4/1975 | Pharris | 29/116 R |
| 4,011,706 | 3/1977 | Düpree | 16/DIG. 13 |

FOREIGN PATENT DOCUMENTS

| | | | |
|---|---|---|---|
| 1402540 | 5/1965 | France | 15/230.11 |

*Primary Examiner*—Wayne L. Shedd

*Attorney, Agent, or Firm*—Cullen, Sloman, Cantor, Grauer, Scott & Rutherford

[57] ABSTRACT

A paint applicator roller formed of a plastic molded cage made in two elongated matching halves which are aligned to form a roughly cylindrical shape for inserting within a tubular applicator core having an outer applicator surface. The axle of the handle frame is journaled within central bearing forming bores located within the cage. The distance between the bearings is less than one-half the length of the core so that the axle is considerably shorter in length than the core. The two cage halves may be opened, i.e., separated, or may be closed, i.e., radially aligned about the frame axle for rotatably mounting the cage upon the axle.

2 Claims, 10 Drawing Figures

PAINT APPLICATOR ROLLER CONSTRUCTION

BACKGROUND OF INVENTION

Paint applicator rollers generally are formed of three parts, namely the interior cage or roller, which is rotatably mounted upon the axle portion of the frame or handle wire and which carries the tubular core whose surface forms the actual paint applicator The tubular core with its applicator surface is normally removable from the cage or roller for cleaning or replacement. Normally the cage or roller is rotatably mounted upon the frame axle in such a manner as to prevent disengagement between the two. That is, they form one unit and are handled as one unit. The axle itself extends the full length of the cage which in turn extends the full length of the tubular core.

Examples of this type of paint applicator roller, particularly pertinent to the construction of this application insofar as is known to applicant are illustrated and described in U.S. Pat. No. 2,741,013 to Messner, issued Apr. 10, 1956, U.S. Pat. No. 2,747,210 to Canning, issued May 29, 1956, U.S. Pat. No. 3,094,770 to Williams, issued June 25, 1963, U.S. Pat. No. 3,638,271 to Pharris, issued Feb. 1, 1972, U.S. Pat No. 3,745,624 to Newman, issued July 17, 1973, U.S. Pat No. 3,744.278 to Ashton, issued Nov. 27, 1973 and U.S. Pat. No. 3,877,123 to Pharris issued Apr. 15, 1975.

As can be seen in the above-identified U.S. patents, the overall construction of the applicators are generally similar, but the details vary considerably and frequently relate to attempts to reduce the cost of each of the unit parts and to increase the strengths thereof. Large quantities of such types of applicators are sold through retail stores to individuals painting their own homes and the like and many of these rollers are used for only a short time and then discarded. Hence, it is desirable to make such roller applicators available at the lowest possible cost, yet at an adequate strength to perform its function properly.

The invention herein is directed toward reducing the cost, without sacrificing strength, of both the cage and the frame, while otherwise producing an applicator generally similar in appearance to and functionally equivalent to those of the past.

SUMMARY OF THE INVENTION

The invention herein contemplates forming the applicator cage or roller out of a plastic molding made in two parts joined together by an integral hinge for folding around the axle of the frame. That is, the cage which is roughly in the shape of a cylinder for insertion within the tubular core, is actually made of two parts split in a diametrical plane, and joined together by an integral hinge so that they may be molded side-by-side and transported and handled as a connected pair of parts and then folded around the frame axle for assembly when desired.

The frame axle itself is shortened to considerably less than the full length of the core or cage, such as roughly one-third the length thereof to thereby eliminate a considerable amount of metal. Nevertheless, its function and strength is substantially equivalent to prior lengthier axles because it is journaled within integral portions of the cage which make up an end plug and a bearing portion connected together by widened, bowed strips which frictionally interlock with the interior surface of the core and reinforce and rigidify the bearing arrangement.

With this construction, the cage may be molded and handled and shipped as a unit and sold at retail, side-by-side with frames, so that the two may be quickly assembled together by the ultimate purchaser without the use of any tools or other equipment and the two may be easily disengaged without tools for replacement of either part. Thus, the home user can inexpensively purchase the core, cage and frame and discard any or all of these parts when worn or otherwise difficult to clean, replacing same with the equivalent parts.

These and other objects and advantages of this invention will become apparent upon reading the following description, of which the attached drawings form a part.

DETAILED DESCRIPTION

Figure 1:
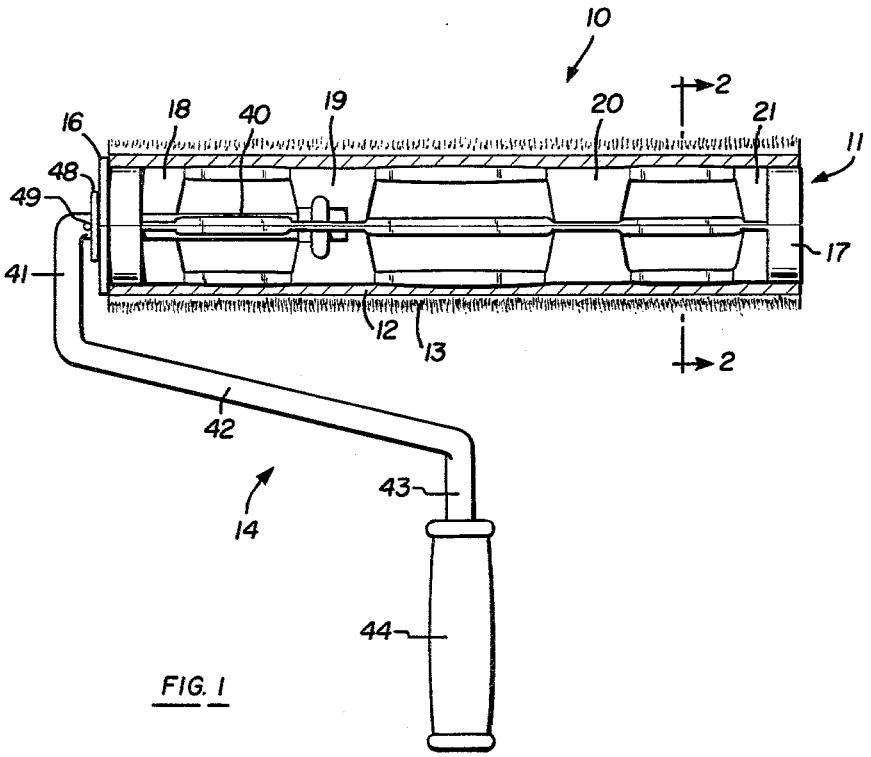
FIG. 1 is an elevational view of a core, cage and frame assembly but with the core shown in cross section.
Figure 2:
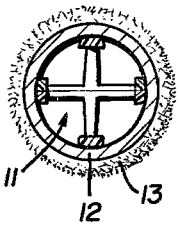
FIG. 2 is a cross-sectional view taken in the direction of arrows 2—2 of FIG. 1.

The paint applicator roller assembly, generally designated as 10, is formed of a cage 11, a tubular core 12 having a fibrous applicator surface 13, and a wire frame 14. The core and its surface are conventional. For example, they may comprise a cardboard tube covered with a flocking material which applies the paint, as is commercially available.

The cage is a plastic molding formed of any suitably available conventional plastic material. It is formed in two identical molded parts 15 and **15*a* which when placed together make up roughly a cylinder split on a diametric plane to form the two parts. Each of the two molded parts include a primary circular, disk-like end plug half 16 and an opposite circular, disk-like end plug half 17**.

Figure 3:
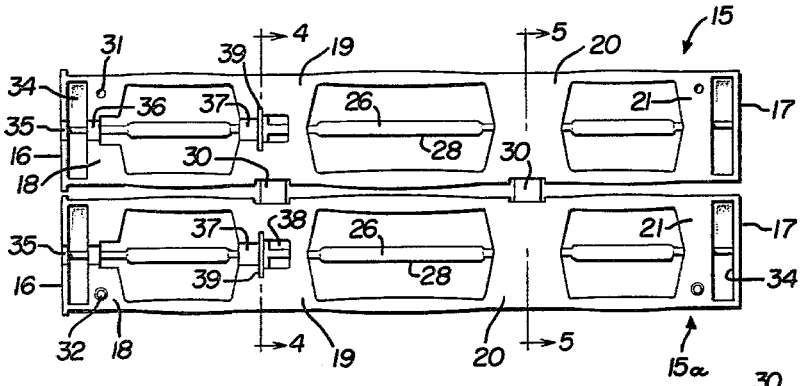
FIG. 3 is a plan view of the cage in its folded open position.
Figure 4:
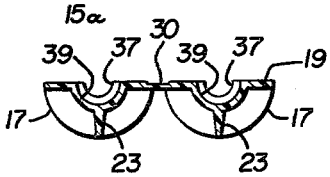
FIG. 4 is a cross-sectional view taken in the direction of arrows 4—4 of FIG. 3.
Figure 5:
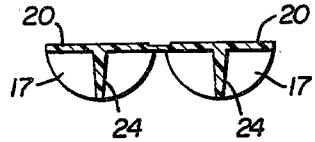
FIG. 5 is a cross-sectional view taken in the direction of arrows 5—5 of FIG. 3.

As can best be seen in FIG. 3, a diametrically directed web 18 is formed adjacent the plug halves 16. Similar intermediate webs 19 and 20 are located at roughly one-third and two-thirds respectively of the distance along the cage from the end plug halves 16. Another web 21 is located at the end plug halves 17. These webs are arranged in face-to-face contact with each other, that is, in pairs, when the two molded parts 15 and **15*a*** are folded together to make up the cylindrical shape.

Cross webs 22, 23, 24 and 25 are molded integral with and at right angles to their respective webs 18, 19, 20 and 21 to extend radially of the axis of the cage.

Longitudinally extending strips 26 interconnect the outer edges of adjacent webs and cross webs. The outer or peripheral faces of the strips form bowed surfaces 27. The strips are sufficiently widened to form linear edges 28 on each strip. The combination of the bowing and the relatively sharp linear edges on each strip frictionally interlock with the interior surface or wall defining the tubular core for securely locking the core to the cage.

The molded parts 15 and 15*a* are hingedly interconnected by integral hinge portions 30. When the parts are folded into face-to-face alignment, they are secured together by pins 32 molded on one of the parts and frictionally fitted within holes or sockets 31 formed on the other part.

The opposite end plugs are formed with hollow interiors 34. The plug halves 16 are each provided with semi-circular bore portions 35 which together make up a bearing. Similar bore portions 36 are formed in the webs 18 and the cross webs 22. Also, bore portions 37 are formed in the intermediate web 19 and its cross webs 23, which bores terminate in a widened or relief bore portion 38.

A narrow, annular socket 39 is formed in the bore portions 37 in the intermediate web and cross web.

The frame 14 is made of a metal wire, such as a steel wire of suitable thickness, as for example of one-eighth of an inch diameter. The frame includes an axle portion 40, an intermediate portion 41, an angular handle portion 42, and the handle part 43 upon which a conventional plastic molded handle 44 is mounted.

The axle portion 40 does not extend the full length of the cage and the core. Rather, it extends far less than one-half of that distance, such as roughly about one-third the length of the cage for journaling within the bore portions 35–36–37. In order to maintain the axle against longitudinal movement relative to the cage, a conventional cap-type lock washer 47 may be frictionally engaged upon its free end and a conventional ring washer 48 may be loosely located upon its opposite end and prevented from axial movement by a bump or strike-out 49 formed on the axle.

The rim of the cap-type washer 47 fits within the annular socket 39 which is molded within the bore 37 of the intermediate web 19 and its cross web 23.

In operation, the cage is preferably formed as a one-piece molding and is handled and shipped in its open position as illustrated in FIG. 3. For use, the cage is folded about its hinges to envelop the axle portion 40 of the frame which is restrained against axial movement relative to the cage due to the washers. However, the cage is free to rotate upon the frame axle.

The cage is held in its closed or roller forming position by the mechanical interlock of the pins 32 and the openings 31. In this position, the tubular core may be slid over the cage and is frictionally interlocked thereto by virtue of the bowing of the surface of the strips 26 as well as their spaced-apart side edges 28.

For disassembly, the core may be slid off the cage and the cage folded open by pulling the two parts hard enough to disengage the pins from the sockets.

The overall construction is very sturdy and rigid for performing the paint roller function, yet is inexpensive to manufacture, using a limited amount of material, and of course, very inexpensive and simple to assemble. Moreover, the reduction in metal required for the frame makes a substantial difference in large volume production.

Figure 7:
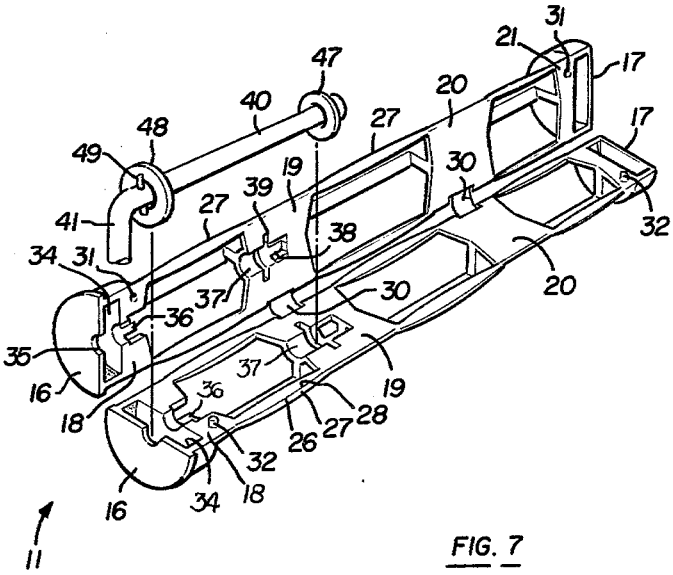
FIG. 7 is a perspective view showing the cage partially folded open and along side of the frame axle.
Figure 6:
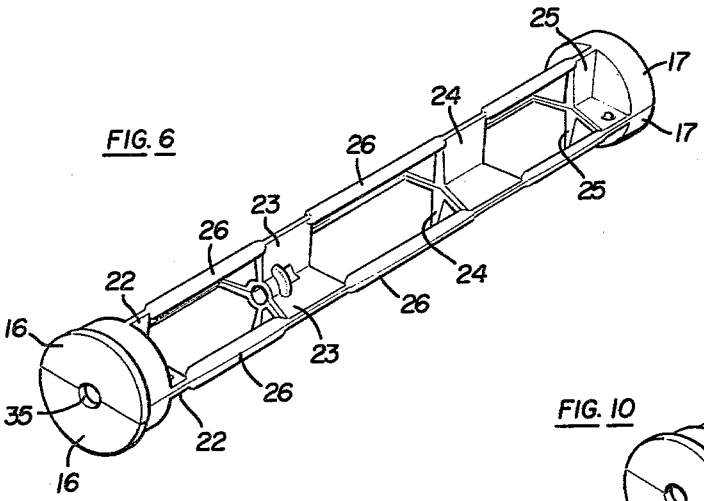
FIG. 6 is a perspective view of the cage in its folded closed or use position.
Figure 10:
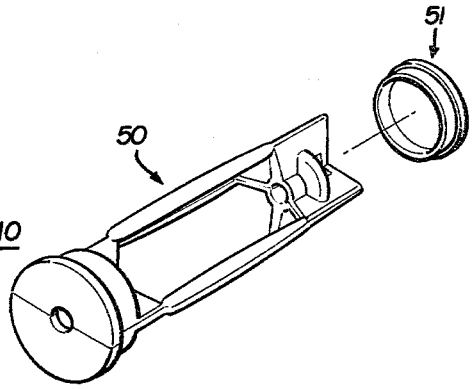
FIG. 10 illustrates, in perspective, a modified cage.
Figure 8:
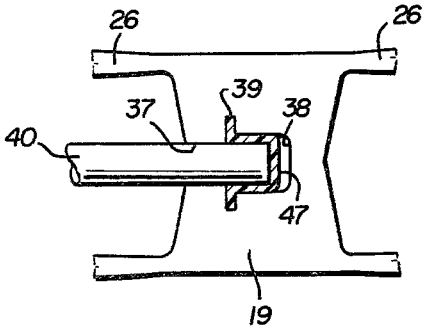
FIG. 8 is an enlarged, fragmentary view of a portion of the bearing.
Figure 9:
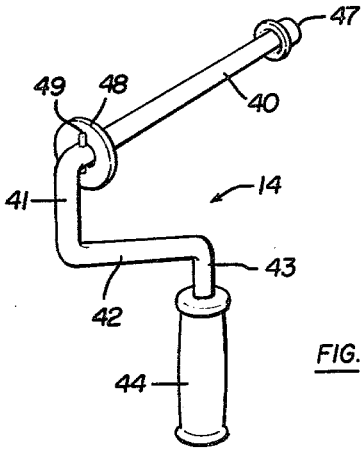
FIG. 9 illustrates the frame, per se.

FIG. 10 illustrates a modification. Here, the cage 50 is identical to the left end of the cage illustrated in FIGS. 3, 6 and 7. That is, the modified cage includes the bored plug end and the intermediate bearing-forming webs and cross webs, interconnected by the strips to the webs adjacent the plug. But, the remainder of the cage is omitted. In order to close the opposite end of a core which is slid over the shortened cage, a separate plug 51, made of suitably molded plastic, is used. The frame used for this construction is the same as that described above.

Hence, it can be seen that the cage, in effect, is foreshortened to provide a lesser gripping surface and supporting surface within the core. For certain types of limited paint work, this can be adequate.

Having fully described an operative embodiment of my invention, I now claim:

1. A molded plastic paint applicator cage for rotatable mounting upon the axle of an applicator handle frame and for insertion within an elongated tubular applicator core, said cage comprising:

a circular disk-like end member having a central bore for receiving the frame axle;

a journal bearing member axially spaced apart from the end member for location within the core at a distance from the end member and including a journal socket for rotatably receiving the free end of the frame axle, and having radially outwardly extending strip portions interconnecting the end member with the bearing member, said strip portions having outer edge portions for closely fitting within the wall defining the interior of the tubular core, said strip outer edges being bowed outwardly relative to the axis of said cage to provide outwardly bowed spaced apart side edge engagement portions with the core;

the end member and bearing member each being split into two parts along a diametric plane, and means for releasably interconnecting the two parts to form the cage rotatably mounted upon the frame axle;

said means for releasably interconnecting including an integral hinge portion interconnecting said two parts for hinging the parts either open, i.e., side by side, or closed, i.e., into bearing forming alignment for engagement with said axle;

the distance between the end member and the bearing member being less than one-half of the length of the tubular core, wherein the frame axle correspondingly extends within the core a distance less than one-half of the length of said core;

an outer plug member for closing the end of the tubular core opposite to the end closed by said end member, and said member, plug and bearing member all being interconnected as one integral molding, including the integral hinge portion;

and said end member including a pair of semi-circular bore halves which together form a first bearing, said journal bearing member including a pair of annular socket halves which together form a second bearing, first and second disk-like fastening means being mounted to said frame axle at spaced apart locations, said first and second disk-like fastening means encased by said bore halfs and said annular socket halves, respectively, when said hinged parts are brought into bearing forming alignment for engagment with said axle to maintain said axle against longitudinal movement relative to said cage.

2. A paint applicator comprising a handle frame having an axle portion, and a plastic molded cage rotatably mounted upon the axle portion and for fitting within a tubular applicator core; comprising:

a circular, disk-like end plug having a central bore for receiving said axle portion;

a bearing member axially spaced from the plug a distance roughly less than the half of the axial length of the core and having a central journal bearing portion and an outer portion shaped to closely fit within the inner wall defining the interior of the core;

the frame axle portion normally extending through the plug bore and having its free end within the bearing portion, wherein the axle is considerably shorter in length than the tubular core;

said cage being divided into two parts along a diametric plane, and means reasonably interconnecting said two parts for opening the cage, i.e., with the two parts side by side, and for closing the cage around the axle, i.e., with the two parts aligned, said means for releasably interconnecting including an integral hinge portion permanently interconnecting the two parts;

said bearing member being formed of a central bearing forming portion and radially outwardly extending webs, and elongated, axially extending strips interconnecting the webs to the end plug, with the strips having widened and radially outwardly bowed outer surfaces for frictionally interconnecting with the interior wall surface defining the tubular core;

and said end plug including a pair of semi-circular bore halves which together form a first bearing, said bearing member including a pair of annular socket halves which together form said central bearing forming portion, first and second disk-like fastening means being mounted to said axle portion at spaced apart locations, said first and second disk-like fastening means being encased by said bore halves and said annular socket halves, respectively, when said hinged parts are brought into closing around said axle portion to maintain said axle portion against longitudinal movement relative to said cage;

and said cage parts each including an integral portion which extends the full length of the tubular core from the bearing member to the opposite end of the core and terminating in a plug forming portion for closing the adjacent core end.

* * * * *